US005230388A

United States Patent [19]

Cherrington

[11] Patent Number: 5,230,388

[45] Date of Patent: Jul. 27, 1993

[54] METHOD AND APPARATUS FOR CLEANING A BORE HOLE USING A ROTARY PUMP

[75] Inventor: Martin D. Cherrington, Fair Oaks, Calif.

[73] Assignee: Cherrington Corporation, Sacramento, Calif.

[21] Appl. No.: 790,223

[22] Filed: Nov. 8, 1991

[51] Int. Cl.[5] ..... E21B 7/28

[52] U.S. Cl. ..... 175/53; 166/68; 166/105; 166/312; 175/62; 175/102; 175/324

[58] Field of Search ..... 166/312, 370, 68, 105, 166/117.7, 68.5, 74; 175/53, 62, 102, 100, 324, 323; 418/48

[56] References Cited

U.S. PATENT DOCUMENTS

| | | | |
|---|---|---|---|
| 2,464,011 | 3/1949 | Wade | 418/48 |
| 3,249,054 | 5/1966 | Hill | 166/68 X |
| 3,536,151 | 10/1970 | Aarup | 175/422 |
| 4,003,440 | 6/1977 | Cherrington | 175/61 |
| 4,091,631 | 5/1978 | Cherrington | 61/72.7 |
| 4,117,895 | 10/1978 | Ward et al. | 175/53 |
| 4,121,673 | 10/1978 | Cherrington | 175/61 |
| 4,176,985 | 12/1979 | Cherrington | 405/184 |
| 4,221,503 | 9/1980 | Cherrington | 405/184 |
| 4,453,603 | 6/1984 | Voss et al. | 175/53 |
| 4,674,579 | 6/1987 | Geller et al. | 175/45 |
| 4,679,637 | 7/1987 | Cherrington et al. | 175/61 |
| 4,714,118 | 12/1987 | Baker et al. | 175/26 |
| 4,744,426 | 5/1988 | Reed | 175/102 |
| 4,784,230 | 11/1988 | Cherrington et al. | 175/61 |
| 4,858,705 | 8/1989 | Thiery | 175/73 |
| 5,015,162 | 5/1991 | Heppner | 418/48 |
| 5,096,002 | 3/1992 | Cherrington | 175/53 |

*Primary Examiner*—Hoang C. Dang
*Attorney, Agent, or Firm*—Alan W. Lintel

[57] ABSTRACT

An apparatus for removing debris from a bore hole comprises a housing having apertures formed therein such that rotation of the housing causing entrapment of the cuttings from the bore hole. The positive displacement pump comprises a rotor surrounded by a stator coupled to the housing such that rotation of the stator rotates the housing. The positive displacement pump is operable to pump material from the housing responsive to relative movement between the rotor and stator. A motor rotates the stator, thereby cleaning the bore hole.

28 Claims, 3 Drawing Sheets

METHOD AND APPARATUS FOR CLEANING A BORE HOLE USING A ROTARY PUMP

RELATED APPLICATION

This application is related to U.S. Pat. Application Ser. No. 07/789,356, (Attorney Docket No. CHE738/4-13), filed Nov. 8, 1991, by Martin Cherrington, entitled "Method and Apparatus for Cleaning a Bore Hole", incorporated by reference herein.

TECHNICAL FIELD OF THE INVENTION

This invention relates in general to hole drilling, and more particularly to a device for removing cuttings from a hole.

BACKGROUND OF THE INVENTION

Underground conduits are widely used for the transmission of fluids, such as in pipelines and the like, as well as for carrying wires and cables for the transmission of electrical power and electrical communication signals. While the installation of such conduits is time-consuming and costly for locations where the earth can be excavated from the surface, the routing of such conduits becomes more difficult where such surface excavation cannot be done due to the presence of surface obstacles through which the excavation cannot easily proceed. Such surface obstacles include highways and railroads, where the installation of a crossing conduit would require the shutdown of traffic during the excavation and installation. Such surface obstacles also include rivers, which present extremely difficult problems for installing a crossing conduit, due to their size and the difficulty of excavation thereunder.

Prior methods for the installation of conduit have included the use of directional drilling for the formation of an inverted underground arcuate path extending between two surface locations and under the surface obstacle, with the conduit installed along the drilled path. A conventional and useful method for installing such underground conduits is disclosed in U.S. Pat. No. 4,679,637, issued Jul. 14, 1987, assigned to Cherrington Corporation, and incorporated herein by this reference This patent discloses a method for forming an enlarged arcuate bore and installing a conduit therein, beginning with the directional drilling of a pilot hole between the surface locations and under a surface obstacle such as a river. Following the drilling of the pilot hole, a reamer is pulled with the pilot drill string from the exit opening toward the entry opening, in order to enlarge the pilot hole to a size which will accept the conduit, or production casing in the case of a pipeline conduit. The conduit may be installed during the reaming operation, by the connection of a swivel behind the reamer and the connection of the conduit to the swivel, so that the conduit is installed as the reaming of the hole is performed. Alternatively, the conduit can be installed in a separate operation, following the reaming of the pilot hole (such reaming referred to as "pre-reaming" of the hole). Additional examples of the reaming operation, both as pre-reaming and in conjunction with the simultaneous installation of the product conduit, are described in U.S. Pat. No. 4,784,230, issued Nov. 15, 1988, assigned to Cherrington Corporation and incorporated by this reference.

While the above-described methods are generally successful in the installation of such conduit, certain problems have been observed, especially where certain types of sub-surface formations are encountered. Referring now to FIGS. 1 and 2, examples of such problems in the installation of conduit in an underground arcuate path will now be described.

FIG. 1 illustrates the reaming operation described above, in conjunction with the installation of production conduit as the reamer is pulled back. In the example of FIG. 1, entry opening 0 is at surface S on one side of river R; exit opening E is on the other side of river R from entry opening 0. At the point in the installation process illustrated in FIG. 1, a drilling apparatus, including a hydraulic motor 14 mounted on a carriage 16 which is in place on an inclined ramp 12, has drilled the pilot bore hole B from entry 0 to exit E, using drill string 10, and the reaming and installation is in progress. Motor 14 is now pulling reamer 48, to which production conduit 46 is mounted, back from exit E toward entry 0. Reamer 48 is larger in diameter than the diameter of production conduit 46. Upon completion of the reaming operation of FIG. 1, if successful, production conduit 46 will be in place under river R, and extending between exit E and entry 0.

Referring now to FIG. 2, a close-up view of the location of reamer 48 and production conduit 46 in FIG. 1 is now illustrated. Leading drill string section 10C is attached by way of tool joint 52 to reamer 48, reamer 48 having cutting teeth at its face. Swivel 50 connects product conduit 46 to reamer 48, by way of extension 62 connected to a sleeve 66 on conduit 46. As is evident from FIGS. 1 and 2, bore hole B is enlarged to enlarged opening D by operation of reamer 48. Conventional sizes of conduit 46 are on the order of 20 to 48 inches in outside diameter, with the size of reamer 48 greater in diameter than conduit 46. Due to reamer 48 being larger than conduit 46, an annulus 68 surrounds conduit 46 as it is pulled into the hole D. Provision of the annulus 68 allows for reduced friction as the conduit 46 is placed therein.

As noted above, prior techniques have also included a pre-reaming step, wherein a reamer, such as reamer 48, is pulled back from exit E to entry 0 without also pulling production conduit 46 into the reamed hole. In such a pre-reaming step, a following pipe generally trails reamer 48 in such the same manner as conduit 46 trails reamer 48 in FIGS. 1 and 2, to provide a string for later installation of conduit 46. Such a trailing pipe will be of a much smaller size than conduit 46 of FIGS. 1 and 2, for example on the order of five to ten inches in diameter.

It has been observed in the field that both the pre-reaming and reaming with installation operations are subject to conduit or pipe sticking problems, especially as the size of the production conduit increases in diameter, and as the length of the path from entry 0 to exit E increases. Such sticking is believed to be due, in large degree, to the inability to remove cuttings resulting from the reaming operation. Due to the large volume of earth which is cut by way of the reaming operation, and the generally low fluid flow velocity of drilling or lubricating mud or fluid into the reaming location, the velocity of cuttings circulating from the reaming location is minimal. While the mud or other lubricating fluid flow could be increased in order to increase the velocity of the cuttings from the reaming location, such an increase in the velocity of the fluid could result in such undesired results as hole wall erosion and fracturing through the formation.

Due to the inability to sufficiently remove the cuttings during the reaming operation, it is believed that the cuttings pack together near the location of the reamer. Many of the cuttings from the reaming operation are heavier than the fluid transporting them and, in such large diameter holes as are required for the installation of conduit, these large cuttings will fall out or settle toward the bottom of the hole first, and then build up into a circumferential packed mass, causing a poor rate of reaming. Referring to FIG. 2, where a production conduit 46 is being pulled through with reamer 48, it is believed that such packing will begin at locations P surrounding the leading end of conduit 46, and also along the sides of conduit 46 in annulus 68. As the cuttings pack together, squeezing whatever water or fluid is present therein, the density of the packed mass increases. Upon sufficient packing, it is believed that pressure builds up ahead of locations P, toward the bit of reamer 48, such pressure resulting from the mud or fluid continuing to be pumped into the reaming location with the return flow reduced at locations P around conduit 46 in annulus 68. It is also believed that this buildup of pressure will also force cuttings into bore hole B ahead of reamer 48, and that these cuttings will also begin to pack, most likely at locations P' near the first tool joint 70 ahead of reamer 48.

The buildup of pressure between locations P and P' surrounding reamer 48 causes significant problems in the reaming operation. Such effects have been observed in the field during reaming operations, when the reamer cannot be rotated, pulled or pushed at a particular location in the operation. It should be noted that the sticking of the reamer occurs both for the pre-reaming operation described hereinabove and for the combined reaming and pulling operation. It should further be noted that the pressure buildup described hereinabove is believed to be worse in high pressure formations such as clay.

Another undesired effect resulting from the buildup of pressure when the reamer cuttings are insufficiently removed is similar in nature to differential sticking in the downhole drilling field. As is well known in the downhole drilling art, differential sticking of the drill string occurs when the pressure of the drilling mud surrounding the drill string is greater than the pressure exerted by the surrounding formation. In the event that the caking of drilling mud and the structure of the well bore is not strong enough to maintain its shape when presented with such a differential pressure, the pressure of the drilling mud can force the drill string into the formation, holding it there with sufficient pressure that it cannot be released from the surface.

It is now believed that similar effects can be present in the field of installation of underground conduit, due to insufficient removal of the reaming cuttings. If the pressure near reamer 48, when packed off as described hereinabove, is sufficiently greater than the pressure exerted by a surrounding formation, the conduit 46 can be driven into the formation, causing sticking of the conduit 46 thereat. It should be noted that the installation of underground conduit is particularly susceptible to such sticking, since much of the formations underlying rivers are sedimentary or alluvial formations, with relatively thin layers of differing strength. Accordingly, the drilling and reaming operations in river crossing installations are exposed to many differing formations along the length of the path, with the likelihood of encountering a weak (in pressure) formation being relatively large. Accordingly, such pressure buildup due to insufficient reaming cutting removal can cause conduit sticking at particular locations along the underground path.

Furthermore, it should be noted that the insufficient removal of cuttings impacts the reaming operation itself. If cuttings are not sufficiently removed from the reaming location, a number of cuttings will tend to be present in front of reamer 48 of FIG. 2; as a result, reamer 48 will tend to recut its own cuttings, rather than cutting the earth in its path and enlarging the hole. This results in poor penetration rates for the reaming operation. As noted above, as the reaming rate slows, the pressure buildup between the packed locations will accelerate, further degrading the operation and increasing the likelihood of the reamer and conduit sticking.

In addition, the recutting of the cuttings results in a high degree of reamer wear, both at the teeth and also in the parent metal of reamer 48. In rotor reamers, such wear has been observed also at the seals and bearings. This has also been observed for reamers which use carbide-coated rotating cones as the cutting bits, in similar manner as a downhole tri-cone bit; while the carbide wears slowly, the insufficient removal of the cuttings has been evidence in significant wear of the parent metal of the reamer. Furthermore, as the cuttings become smaller due to multiple recutting cycles, the cuttings which are removed with the drilling mud are much more difficult to process by the solids control system.

Other methods for installing conduit in an underground path includes forward thrust techniques, such as described in U.S. Pat. Nos. 4,176,985, 4,221,503 and 4,121,673. Particularly, U.S. Pat. No. 4,176,985 discloses an apparatus which thrusts a casing into a pilot hole, with a bit leading the casing. However, which such forward thrust techniques are useful for unidirectional application such as the introduction of conduits into the ocean, such methods place significant stress on the conduit itself, and also present relatively slow installation rates. The pull-back methods described hereinabove and hereinbelow are preferable from the standpoint of reduced stress on the casing, as well as increased installation rates.

A method and apparatus for removing cuttings is described in U.S. Pat. No. 5,096,002 to Cherrington, filed Jul. 26, 1990, entitled "Method and Apparatus for Enlarging an Underground Path", which is incorporated by reference herein. While the device described in U.S. Ser. No. 5,096,002 is effective in removing the cuttings, it relies on several moving parts, which may decrease its reliability.

Therefore, a need has arisen in the industry for a method and apparatus for removing cuttings from a bore hole with a reduced number of working parts.

SUMMARY OF THE INVENTION

The method and apparatus of the present invention provides for effective removal of cuttings from a bore hole which substantially overcomes problems associated with other such devices. The apparatus comprises a housing having apertures formed therein, such that rotation thereof causes entrapment of cuttings from the bore hole. A positive displacement pump comprises a rotor surrounded by a stator coupled to the housing, such that rotation of the stator causes rotation of the housing. The positive displacement pump is operable to pump material from the housing responsive to relative movement between the rotor and stator. A motor rotates the stator, thereby entrapping the cuttings in the housing and pumping the cuttings from the bore hole.

The present invention provides significant advantages over the prior art. Rotation of the stator results in both the entrapment of cuttings and the pumping action. Furthermore, the apparatus uses a small number of moving parts, thereby improving reliability. Also, the apparatus may be coupled with a reaming device, such that rotation of the reaming device, stator, and housing may be performed simultaneously.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 3-6 of the drawings, like numerals being used for like and corresponding parts of the various drawings.

Figure 3:
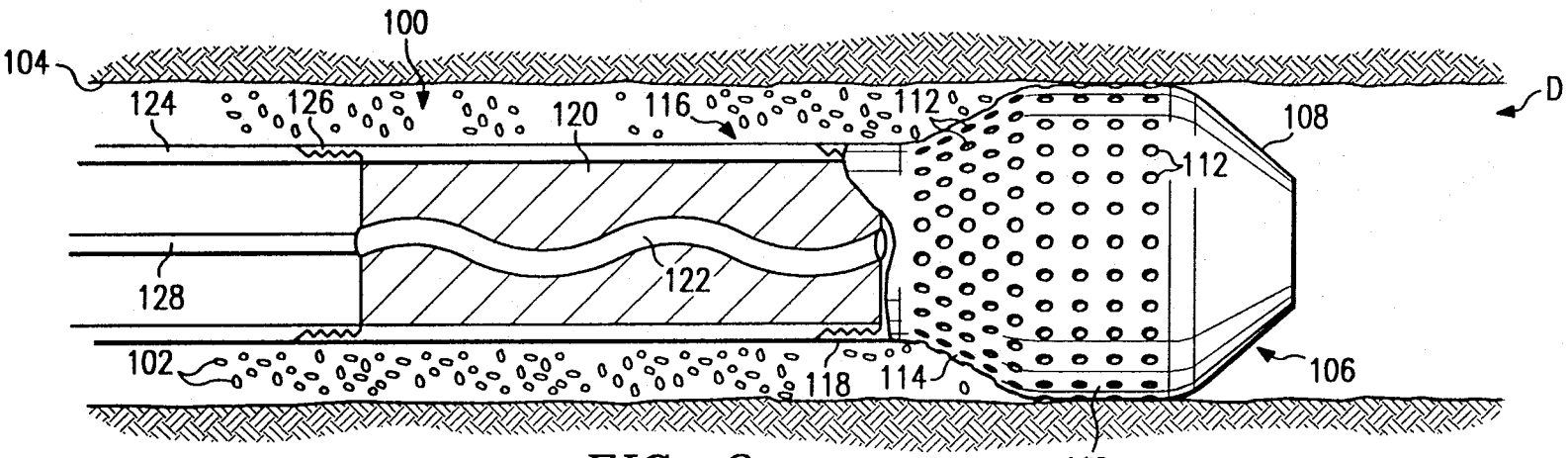
FIG. 3 is cutaway view of the preferred embodiment of the hole cleaning device of the present invention.

FIG. 3 illustrates a cutaway view of a preferred embodiment of hole cleaning device of the present invention, where the hole cleaning device is used to remove cuttings from a hole which has already been drilled to substantially the desired diameter. In FIG. 3, the hole cleaning device 100 is shown in hole D having cuttings 102 remaining on the walls 104 of hole D. The hole cleaning device 1? ? comprises a front housing 106 having a front tapered end 108, a cylindrical section 110 having apertures 112 formed therein, and a rear tapered end 114, also having apertures 112 formed therein. The front housing 106 is coupled to a positive displacement pump, shown as Moyno pump 116, by threaded connection 118. Moyno pump 116 includes a stator 120 and a rotor 122. The stator 120 is coupled to drill pipe 124 by threaded connection 126. Pipe 128 is disposed within drill pipe 124 and is coupled to rotor 122.

In a positive displacement pump, the pumping action is caused by a displacement produced by a decrease in volume. A Moyno pump uses a helical screw rotor which revolves within a casing (or "stator"). The stator is shaped such that cavities formed at the inlet progress toward the outlet side of the pump as the helical screw rotates. Creation of the cavity at the inlet side produces a partial vacuum which causes material to flow into the pump. The material is carried in the progressing cavity to the discharge side of the pump. Once the material has reached the discharge side of the pump, the shape of the casing causes the cavity to close, thereby causing an increase in pressure which forces the material into the outlet line. The discharge pressure may be adjusted by varying the length and pitch of the rotor 122.

In operation, drill pipe 124 is rotated while pipe 128 is held stable, thereby causing relative movement between the stator 120 and rotor 122. Rotation of the drill pipe 124 also causes housing 106 to rotate within hole D. Rotation of the housing 106 creates a grating effect with the cuttings 102, pushing the cuttings into the internal cavity of the housing 106. The vacuum created by relative movement between the stator 120 and rotor 122 creates a pumping action to pump the cuttings from the interior of the housing 106 through the Moyno pump 116 and out the drill pipe 124 to the surface for processing.

An alternative embodiment, the pipe 128 is not held in position, but is rotated in the direction opposite to that of the stator, thereby increasing the pumping effect.

While Moyno pumps have been used in the prior art to remove cuttings (see, for example, U.S. Pat. No. 4,091,631 to Cherrington, issued May 30, 1978, entitled "System and Method for Installing Production Casings"), use of the Moyno pump has entailed providing impetus to the rotor of the Moyno pump. By rotating the stator, however, the housing 106 may be rotated as well, thereby simplifying the mechanics of the hole cleaning device. Further, as described hereinbelow, the stator may be further coupled to a reaming device, making additional use of the rotation of the stator 120.

Figure 4:
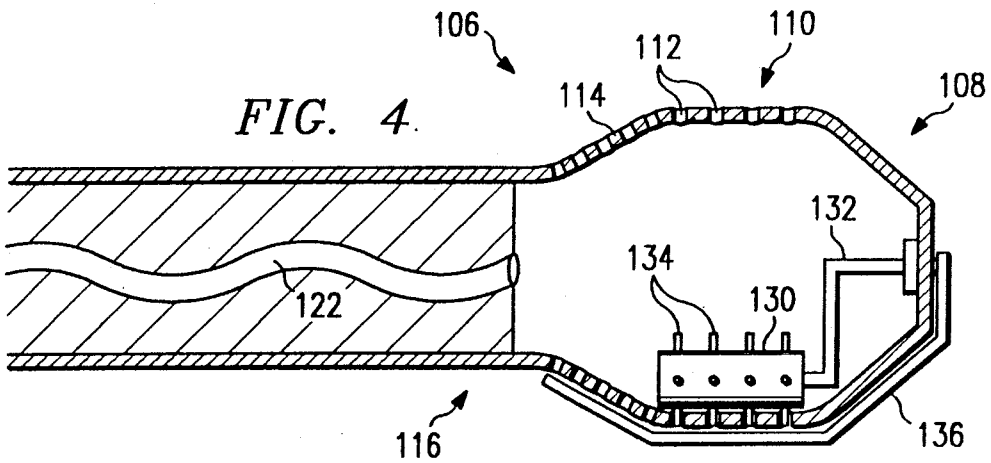
FIG. 4 is a cross-sectional side view of a alternative embodiment of the present invention incorporating a device for unclogging apertures in the housing.

FIG. 4 illustrates a cross-sectional side view of the housing 106, illustrating an alternative embodiment of the present invention, wherein apparatus is provided to remove debris from the apertures 112 during operation of the device. A rotating cylindrical device 130 is rotatably coupled to arm 132. Arm 132 is likewise rotatably coupled to the housing 106. Cylindrical device 130 has extrusions 134 which mate with the apertures 112. Further, a scraper 136 is rotatably coupled to the exterior of housing 106.

In operation, when housing 106 is rotated, the scraper 136 removes debris stuck to the exterior of housing 106. After scraping, cylindrical device 130 interacts with the apertures 112, thereby pressing out any cuttings which have been stuck in the apertures.

Figure 5:
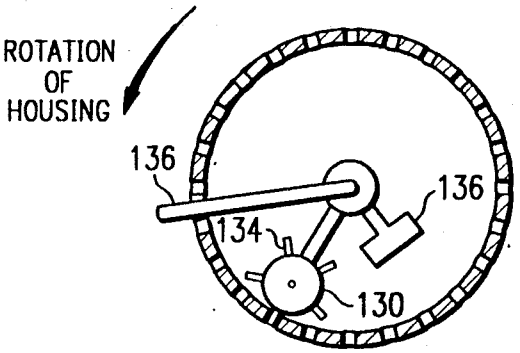
FIG. 5 illustrates a front view of the aperture cleaning device of FIG. 4.

It is shown in greater detail in FIG. 5, an optional counterweight 138 is coupled to the arm 132. It is believed that the counterweight may aid in offsetting the scraper 136 and cylindrical device 130.

Further, while the embodiment shown in FIGS. 3-5 is designed for removing cuttings 102 after the hole is formed, the hole cleaning device 100 could be combined with a reamer or other hole opening device such that the formation of the hole and the removal of the cuttings occur simultaneously. A preferred embodiment of such a device is shown in FIG. 6.

Figure 6A:
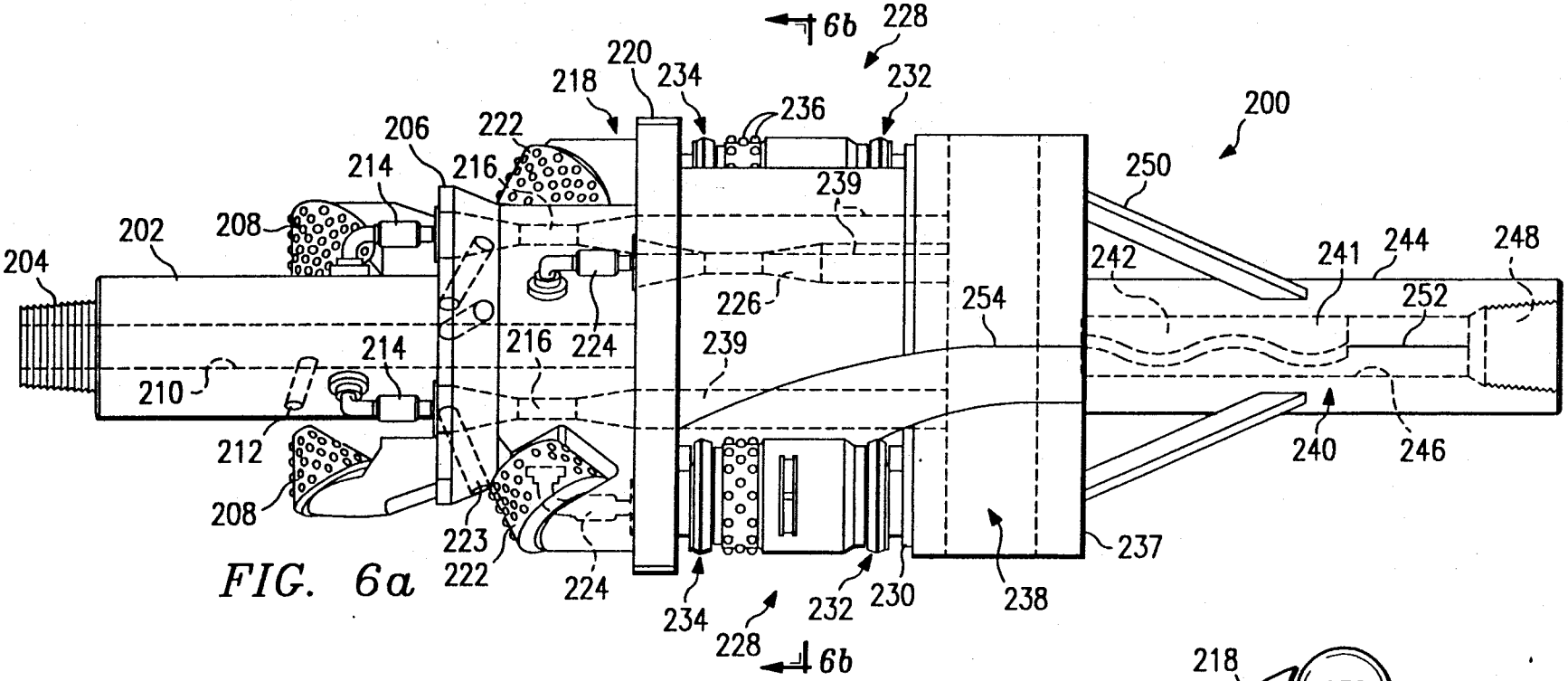
FIGS. 6*a* and 6*b* illustrate a perspective view of a combination reamer/hole cleaning device.
Figure 6B:
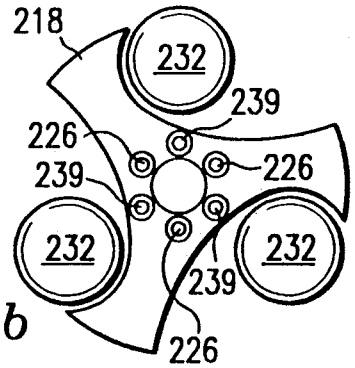

FIG. 6*a* illustrates a perspective view of a reamer/-hole cleaner 200 which simultaneously enlarges a hole and removes cuttings from the enlarged hole. The reamer/hole cleaner 200 comprises a leading sub 202 having a threaded connecting member 204 for attaching to a leading drill pipe. A cutter mounting plate 206 is attached to the sub 202. First stage cutters 208 extend outwardly from the cutting mounting plate 206. In the preferred embodiment, there are three first stage cutters 208 spaced evenly about the circumference of the cutter mounting plate 206.

An inlet pipe 210 is formed through the sub 202 and continues through the reamer/hole cleaner body. A plurality of cleaning jets 212 are in communication with the inlet pipe 210. Also coupled to the inlet pipe 210 are jet nozzles 214. The jet nozzles 214 are in communication with diffusers 216 formed through the mounting plate 206 and the body 218 of the reamer/hole cleaner 200.

A second stage mounting plate 220 is coupled to the body 218. The second stage mounting plate 220 is coupled to second stage cutters 222. Second stage cleaning jets 223 are coupled to inlet pipe 210. Second stage jet nozzles 224 are coupled to inlet pipe 210 and are in communication with second stage diffusers 226. In the preferred embodiment, there are three jet nozzle 224/diffuser 226 assemblies interspersed about the circumference of the second stage mounting plate 220.

Stabilizers 228 are rotatably mounted between mounting plates 220 and 230. Each stabilizer comprises a roller portion 232 and a cutting portion 234 having teeth 236. Rear housing 237 forms a chamber 238. In the preferred embodiment, rear housing 237 has apertures to further remove cuttings from the hole.

The diffusers 216 and 226 feed into a chamber 238 through transfer pipes 239. A positive displacement pump (Moyno pump 240) having stator 241 and rotor 242 has a suction end in communication with chamber 238 and a discharge end in communication with trailing sub 244. Trailing sub 244 has an outlet pipe 246 coupled to a threaded connecting portion 248. Supports 250 are coupled between the body 218 and sub 244. Pipe 252 is coupled to rotor 242.

Figure 1:
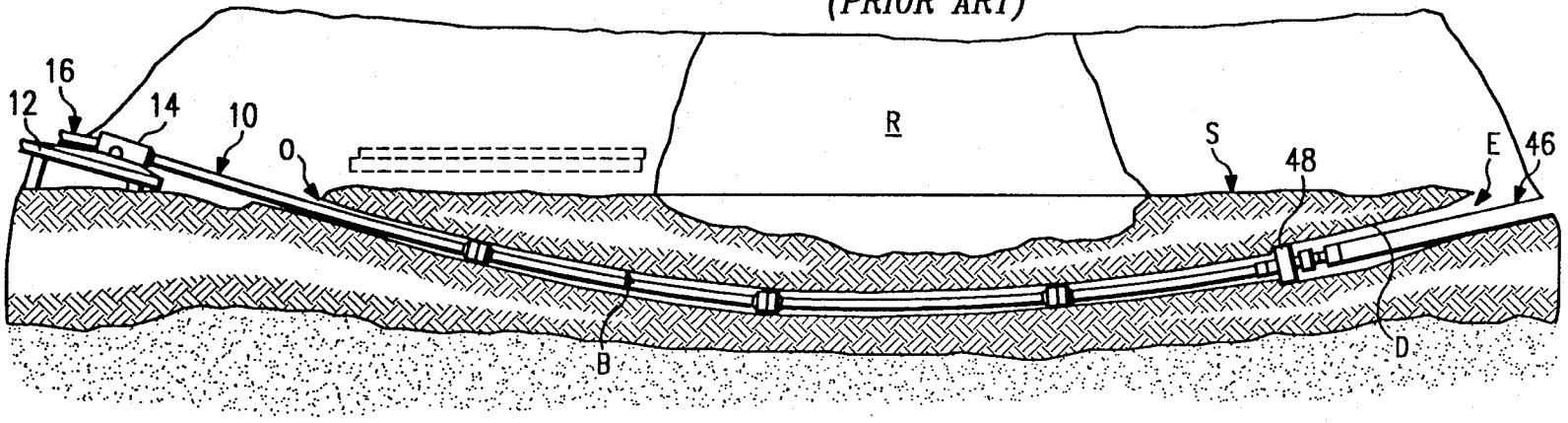
FIG. 1 (PRIOR ART)
FIGS. 1 and 2 are cross-sectional drawings showing apparatus for reaming and installing a conduit according to prior art.
Figure 2:
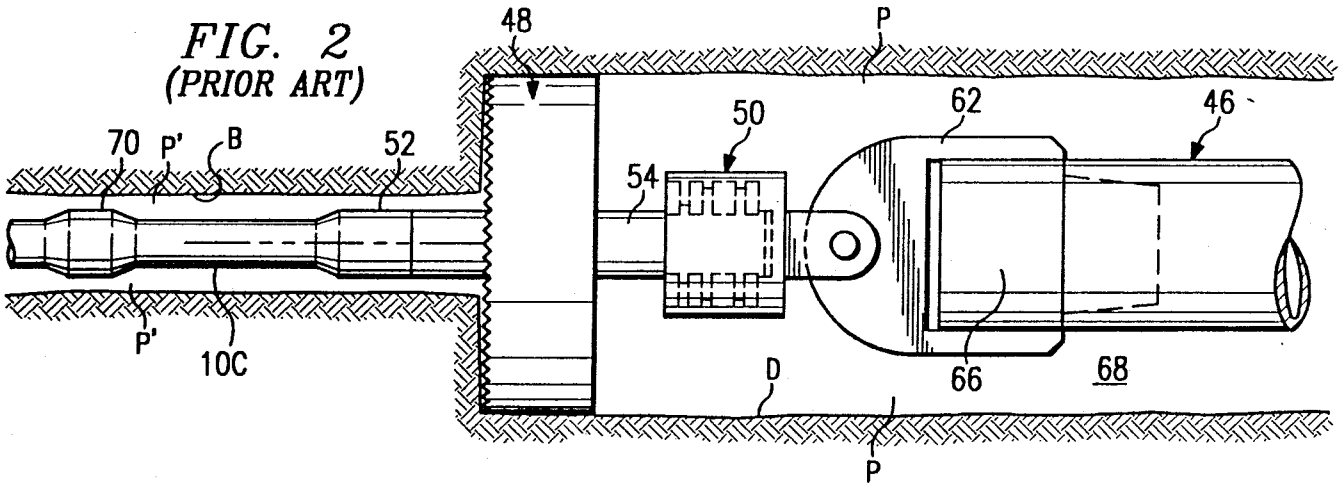
FIG. 2 (PRIOR ART)

In operation, the cleaner/reamer 200 is rotated through an initial bore hole, as is described in connection with FIG. 1. Rotation of the cutters 208 and stator 241 are performed by rotating the leading drill pipe or the trailing drill pipe. Rotor 242 is held in place by pipe 252. The first and second stage of cutters 208 and 222 enlarge the diameter of the bore hole to a desired diameter. Stabilizers 228 (positioned as shown in connection with FIG. 6*b*) maintain the reamer/hole cleaner 200 within the hole. The cutting portion 234 of the stabilizers 228 remove any remaining debris from the walls of the enlarged bore hole which would otherwise create undue friction with the rolling portion 232, thereby wear down the rolling portion 232 and reducing its stabilizing effect.

During the reaming operation, water or drilling fluid is forced through inlet pipe 210. The fluid is expelled at cleaning jets 212 which spray against the cutters 208 to remove any debris which has struck to the cutters 208. Similarly, fluid is forced from the second stage cleaning jets 223 which clean cutters 222.

Additionally, fluid forced through inlet pipe 210 is expelled through first stage jet nozzles 214 and second stage jet nozzles 224. The combination of jet nozzles 214 and diffusers 216, and jet nozzles 224 and diffusers 226 each create a jet pump. The first stage jet nozzles 214/diffusers 216 create a low-pressure area behind cutters 208, thereby creating a suction to remove cuttings created from first stage cutters 208. The cuttings removed at this stage are transported through diffuser 216 and associated pipes 239. The second stage jet nozzles 224 and diffusers 226 remove cuttings created from the reaming action of second stage cutters 222. These cuttings are transported through diffuser 226 and associated pipes 239 to chamber 238, along with the cuttings from the first stage jet pumps. The cuttings from both stages are removed via the Moyno pump 240 along with cuttings received through housing 237. These cuttings are removed via outlet pipe 246 to exit hole E, where the fluid and cuttings are processed by a solids control substation.

Another important aspect of the cutter/reamer 200 is the spiraling grooves 254 formed in the body 218. The grooves 254 further act to pump cuttings away from the cutters 208 and 222 to reduce wear on the cutters.

The present invention provides significant advantages over the prior art in that cuttings may be removed without additional working parts, thereby increasing the reliability of the hole cleaning device. While the pump illustrated herein is a Moyno pump, similar pumps using relative rotation of a rotor and stator may also be used. Other such pumps are described in greater detail in "Pumping of Liquids", by F. A. Holland and F. S. Chapman, Reinhold Publishing Corporation (1966).

Further, variations of the flow of drilling fluid can be restructured such that the fluid both enters and exits the reamer/hole cleaner 200 from a single site. This aspect of the invention is discussed in greater detail in U.S. Patent Application No. 07/789,356, to Cherrington, entitled "Method and Apparatus for Cleaning A Bore Hole", filed concurrently herewith, which is incorporated by reference herein.

Although the present invention and its advantages have been described in detail, it should be understood that various changes, substitutions and alterations can be made herein without departing from the spirit and scope of the invention as defined by the appended claims.

What is claimed is:

1. Apparatus for removing debris from a hole comprising:

a housing having apertures formed therein such that rotation thereof causes entrapment of debris from the hole;

a positive displacement pump comprising a rotor surrounded by a stator coupled to said housing such that rotation of said stator causes rotation of said housing, said positive displacement pump for pumping material from said housing responsive to relative movement between the rotor and stator;

a reamer coupled to said stator; and a motor for rotating said stator.

2. The apparatus of claim 1 wherein said positive displacement pump comprises a Moyno pump.

3. The apparatus of claim 2 and further comprising means for holding said rotor stationary.

4. The apparatus of claim 1 and further comprising means for rotating said rotor opposite to the direction of rotation of said stator.

5. The apparatus of claim 1 and further comprising cleaning apparatus for removing debris from said apertures.

6. The apparatus of claim 5 wherein said cleaning apparatus comprises a roller coupled to and disposed within said housing, said roller including extruding members for mating with said apertures.

7. The apparatus of claim 6 wherein said cleaning apparatus further comprises a scraper coupled to said housing for scraping debris from the apertures.

8. The apparatus of claim 5 wherein said cleaning apparatus comprises a scraper coupled to said housing for scraping debris from the apertures.

9. The apparatus of claim 1 and further comprising a plurality of stabilizers coupled to said reamer for stabilizing the reamer within the hole.

10. A method for removing debris from a hole comprising the steps of:

rotating the stator of a positive displacement pump relative to a rotor to create a suction;

rotating a reamer in conjunction with rotating said stator;

rotating a housing having apertures formed therein responsive to the rotation of the stator, rotation of the housing transferring the debris from the hole to the interior of the housing;

pumping the debris from the interior of the housing through the positive displacement pump.

11. The method of claim 10 wherein said step of rotating the stator of a positive displacement pump comprises the step of rotating the stator of a Moyno pump.

12. The method of claim 10 and further comprising the step of rotating the rotor opposite to the direction of rotation of said stator.

13. The method of claim 10 and further comprising the step of holding the rotor stationary.

14. The method of claim 10 and further comprising the step of removing debris from said apertures.

15. The method of claim 14 wherein said step of removing debris from the apertures comprises the step of rolling a cylinder including extruding members for mating with said apertures about the interior of the housing.

16. The method of claim 15 wherein said step of removing debris from the apertures further comprises the step of scraping debris from the apertures with a scraper coupled to the exterior of said housing.

17. The method of claim 14 wherein said step of removing debris from the apertures comprises the step of scraping debris from the apertures with a scraper coupled to the exterior of said housing.

18. The method of claim 10 and further comprising the step of stabilizing the reamers within the hole.

19. Apparatus for removing debris from a hole comprising:

a housing having apertures formed therein such that rotation thereof causes entrapment of debris from the hole;

a positive displacement pump comprising a rotor surrounded by a stator coupled to said housing such that rotation of said stator causes rotation of said housing, said positive displacement pump for pumping material from said housing responsive to relative movement between the rotor and stator;

a motor for rotating said stator; and cleaning apparatus for removing debris from said apertures.

20. The apparatus for claim 19 wherein said cleaning apparatus comprises a roller coupled to and disposed within said housing, said roller including extruding members for mating with said apertures.

21. The apparatus of claim 20 wherein said cleaning apparatus further comprises a scraper coupled to said housing for scraping debris from the apertures.

22. The apparatus of claim 19 wherein said cleaning apparatus comprises a scraper coupled to said housing for scraping debris from the apertures.

23. A method for removing debris from a hole comprising the steps of:

rotating a stator of a positive displacement pump relative to a rotor to create a suction;

rotating a housing having apertures formed therein responsive to the rotation of said stator, rotation of the housing transferring the debris from the hole to the interior of the housing;

forcing debris lodged in said apertures to the exterior of the housing; and pumping the debris from the interior of the housing through the positive displacement pump.

24. The method of claim 23 wherein said step of forcing debris from the apertures comprises the step of rolling a cylinder including extruding members for mating with said apertures about the interior of the housing.

25. The method of claim 24 wherein said step of removing debris from the apertures further comprises the step of scraping debris from the apertures with a scraper coupled to the exterior of said housing.

26. The method of claim 23 wherein said step of removing debris from the apertures comprises the step of scraping debris from the apertures with a scraper coupled to the exterior of said housing.

27. Apparatus for removing debris from a hole comprising:

a housing having apertures formed therein such that rotation thereof causes entrapment of debris from the hole;

a positive displacement pump comprising a rotor surrounded by a stator coupled to said housing such that rotation of said stator causes rotation of said housing, said positive displacement pump for pumping material from said housing responsive to relative movement between the rotor and stator;

a motor for rotating said stator; and means for rotating said rotor opposite to the direction of rotation of said stator.

28. A method for removing debris from a hole comprising the steps of:

rotating a stator of a positive displacement pump and a rotor of said positive displacement pump in opposite directions to create a suction;

rotating a housing having apertures formed therein responsive to the rotation of the stator, rotation of the housing transferring the debris from the hole to the interior of the housing; and pumping the debris from the interior of the housing through the positive displacement pump.

* * * * *